US007849589B2

(12) United States Patent
Morrow

(10) Patent No.: US 7,849,589 B2
(45) Date of Patent: Dec. 14, 2010

(54) MULTI-CABLE CONNECTOR ASSEMBLY TOOL

(75) Inventor: David L. Morrow, Chester, CT (US)

(73) Assignee: Ben Hughes Communication Products Company, Chester, CT (US)

( * ) Notice: Subject to any disclaimer, the term of this patent is extended or adjusted under 35 U.S.C. 154(b) by 361 days.

(21) Appl. No.: 12/013,544

(22) Filed: Jan. 14, 2008

(65) Prior Publication Data

US 2009/0178272 A1 Jul. 16, 2009

(51) Int. Cl.
*H01R 43/00* (2006.01)

(52) U.S. Cl. ..... 29/748; 29/747; 29/749; 29/564.4; 29/33 M

(58) Field of Classification Search ..... 29/748, 29/747, 464, 468, 463, 426.3, 33 M, 564.4, 29/749; 227/67, 68, 69; 74/128, 129, 142, 74/143, 69.21; 439/595, 596, 603, 752
See application file for complete search history.

(56) References Cited

U.S. PATENT DOCUMENTS

| | | | | |
|---|---|---|---|---|
| 3,650,452 | A * | 3/1972 | Finke | 227/67 |
| 4,370,016 | A * | 1/1983 | Hayes | 439/468 |
| 4,456,161 | A * | 6/1984 | Russell | 227/67 |
| 4,664,306 | A * | 5/1987 | Levy | 227/67 |
| 5,529,233 | A * | 6/1996 | Davignon et al. | 227/67 |

* cited by examiner

*Primary Examiner*—Derris H Banks
*Assistant Examiner*—Tai Nguyen
(74) *Attorney, Agent, or Firm*—Michaud-Kinney Group LLP

(57) ABSTRACT

A tool for installing connectors on cables includes a base member and a plunger movably mounted on the base member. A lever mechanism on the base member moves the plunger. There is a wheel member that carries a plurality of dog fixtures thereon. A detent mechanism provides engagement between the wheel member and the base member to define a plurality of rotational positions for the wheel member. In each rotational position, a dog fixture is aligned with the plunger. Preferably, each dog fixture on the wheel member is configured to receive a different size cable.

9 Claims, 3 Drawing Sheets

MULTI-CABLE CONNECTOR ASSEMBLY TOOL

FIELD OF THE INVENTION

This invention relates to a tool for installing end connectors on cables and in particular, to a tool for installing a connector on the end of a coaxial cable.

BACKGROUND

Coaxial cable is widely used to carry radio and television signals, digital data and the like. To make the many connections required for the various kinds of electronic data networks that employ coaxial cables, numerous types and sizes of coaxial cable connectors are required on the ends of the cables. A connector is often secured to the prepared end of a coaxial cable by axially compressing the connector, i.e. by compressing the connector in a direction that is parallel to the longitudinal axis of the coaxial cable. Connectors that are applied this way are available for different cable diameters and have heretofore required different tools for compressing them. In addition, some prior art tools for applying connectors to coaxial cables are cumbersome to use and often require two hands.

SUMMARY OF THE INVENTION

The present invention resides in one aspect in a tool that comprises a base member and a plunger movably mounted on the base member. There is a lever mechanism on the base member for moving the plunger. There is also a wheel member rotatably mounted on the base member and a plurality of dog fixtures are mounted on the wheel member. There is a detent mechanism that provides engagement between the wheel member and the base member to define a plurality of rotational positions for the wheel member. Each rotational position disposes a dog fixture in alignment with the plunger. The plunger is movable from a retracted position to an advanced position relative to a dog fixture aligned with the plunger. Preferably, each dog fixture on the wheel member is configured to receive a different size cable.

DETAILED DESCRIPTION OF THE INVENTION

Figure 1:
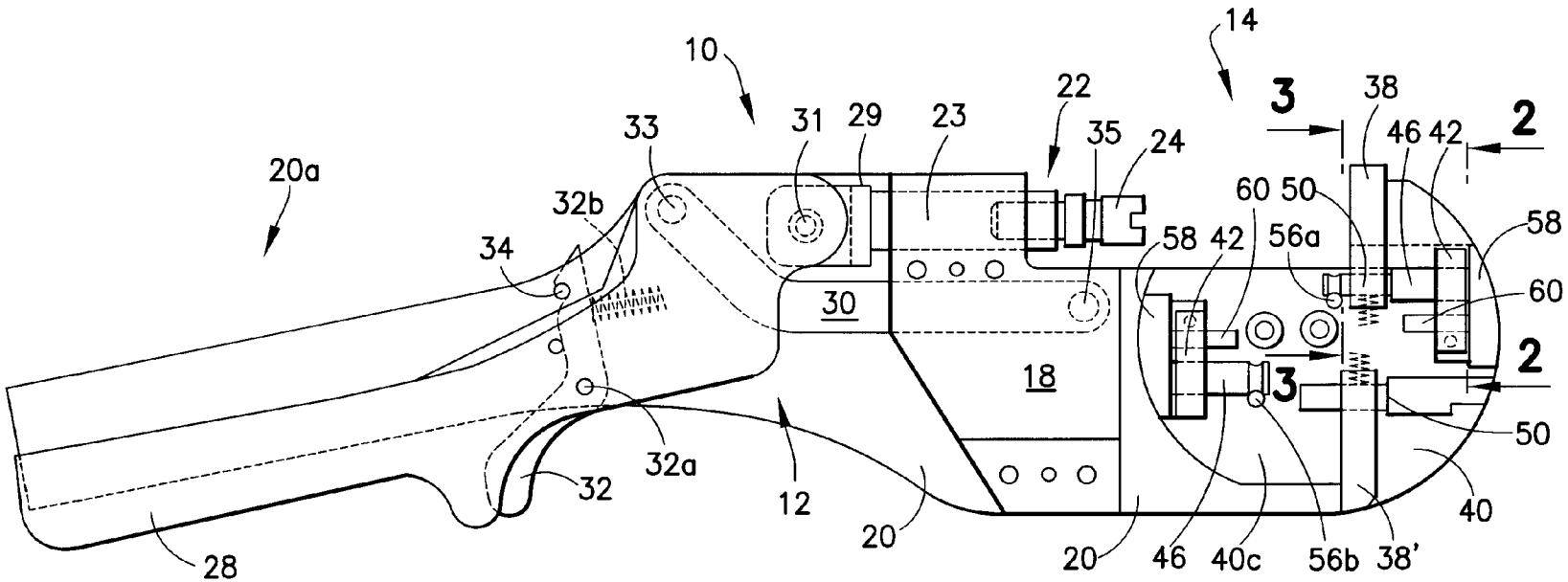
FIG. 1 is a schematic, partly broken-away elevation view of an assembly tool according to one embodiment of the invention.

As shown in FIG. 1, a multi-cable connector assembly tool 10 comprises a plunger assembly 12 and a wheel assembly 14. The plunger assembly 12 comprises a plunger block 18 and a pair of body members 20 (only one shown). The body members 20, in the illustrated embodiment, are mirror images of one another. The plunger block 18 is positioned between and coupled to the body members 20. A plunger 22 is slidably mounted in the plunger block 18 for rectilinear movement toward and away from the wheel assembly 14 between an extended and retracted position. The plunger 22 includes a plunger shaft 23 and a plunger tip 24 mounted on a forward end of the plunger shaft 23. As will be described in greater detail below, the plunger tip 24 is configured to engage a cable connector (not shown) when the plunger 22 is moved toward the advanced position, to secure the cable connector onto the end of a cable. The plunger tip 24 may be removable from the plunger shaft 24; for example, the plunger tip may be threaded into the end of the plunger shaft.

The assembly tool 10 includes a lever mechanism (unnumbered) for moving the plunger 22 from the retracted position to the extended position. The lever mechanism includes a handle portion 28 pivotally connected to an end 29 of the plunger 22 for pivotal movement about a first pivot axis 31. The handle portion 28 is also pivotally connected to a first end of a linkage 30 for pivotal movement about a second pivot axis 33. The linkage 30 is coupled at a second end generally opposite the first end of the linkage to the plunger block 18 for pivotal movement about a third pivot axis 35. A trigger 32 is pivotably mounted on the lever 28 to releasably engage a pin 34 on the body member 20. The trigger 32 includes an upper portion of a shape complementary to the pin 34 so that when the trigger is in a locked position, as shown in FIG. 1, the handle member 8 is in a retracted position and the upper portion of the trigger grippingly and releasably engages the pin. When the trigger 32 engages the pin 34, the lever 28 is held in a storage position. The trigger 32 may be disengaged from the pin 34 and moved to an unlocked position by pressing the trigger 32. This pivots the trigger 32 about the trigger pin 34*a*, against the bias of the trigger spring 32*b*. The trigger spring 32*b* is mounted to the handle member 28 for urging the trigger towards the locked position. The lever 28 can then move under the impetus of a kick-out spring (not shown) to a first position that corresponds to the retracted position for the plunger 22. As described elsewhere herein, in use, a user grasps the assembly tool 10 and squeezes the handle member 28 to advance the plunger 22 toward the extended position.

The wheel assembly 14 comprises a wheel member 40 that is positioned between and rotatably mounted to the body members 20. Still referring to FIG. 1, and as will be explained in detail below, the wheel includes a pair of dog fixtures 38 mounted thereon generally opposite one another. The wheel member 40 can be rotated to different alignment positions in which one of the dog fixtures 38 is aligned with the plunger 22. The assembly tool 10 includes one or more detent mechanisms 42 to help retain the wheel member 40 in the alignment positions. A dog fixture 38 that is aligned with the plunger 22 cooperates with the plunger to secure a cable connector on the end of a cable. While a pair of dog fixtures 38 have been shown and described, the present invention is not limited in this regard as any number of different dog fixtures can be mounted on the wheel member without departing from the broader aspects of the present invention.

Figure 2:
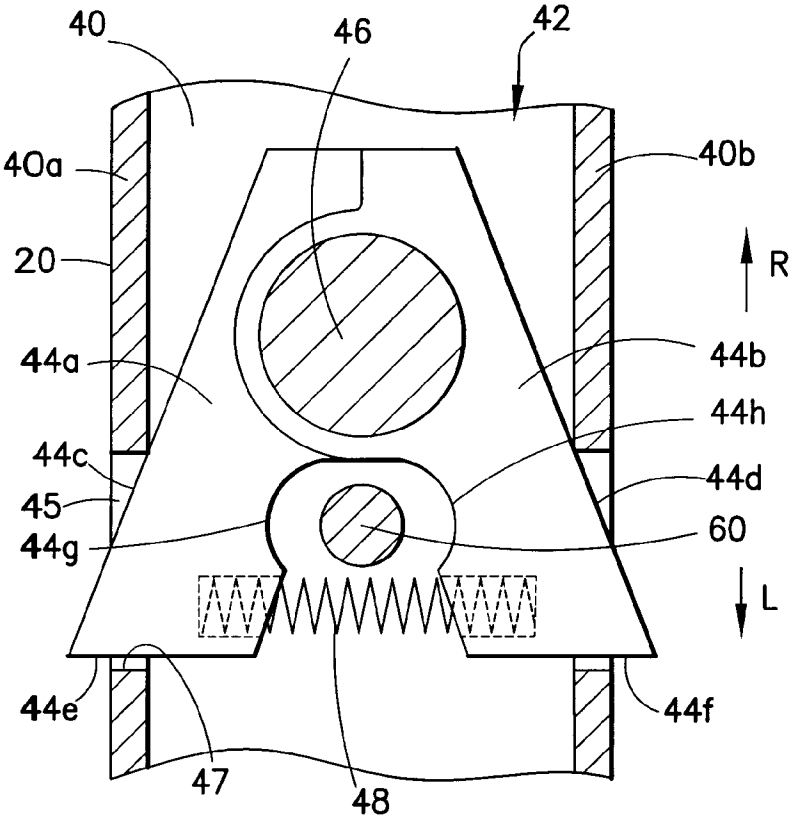
FIG. 2 is a schematic elevation view of the detent mechanism of the assembly tool shown in FIG. 1, taken along line 2-2.

One embodiment of a detent mechanism 42 is shown in FIG. 2. The detent mechanism 42 comprises two detents 44*a*, 44*b*. The detents 44*a*, 44*b* are pivotably mounted on a wheel lock pin 46 that is mounted in the wheel member 40, and the detents pivot about an axis that is substantially parallel to the sides 40*a*, 40*b* of the wheel member. The detents 44*a*, 44*b* pivot between extended positions and depressed positions. In the extended position, one of the detents 44*a* or 44*b* protrudes beyond the profile of the wheel member 40 (i.e., beyond a side 40*a* or 40*b*) as shown in FIG. 2. The detent mechanism 42 includes a wheel lock spring 48 between the two detents 44*a*, 44*b* to bias the detents into the extended positions. Each of the detents 44*a*, 44*b* has a ramped surface 44*c*, 44*d* that extends beyond the sides 40*a*, 40*b* of the wheel member 40. Each of the detents 44*a*, 44*b* also has a stop surface 44*e*, 44*f* that extends beyond the sides 40*a*, 40*b* of the wheel member 40. Pressure on the ramped surfaces 44*c*, 44*d* can cause detents 44*a*, 44*b* to compress the wheel lock spring 48 and allow the detents to pivot to the depressed positions by receding into the profile of the wheel member 40. However, each of the detents 44*a*, 44*b* is configured so that direct pressure on the stop surface 44*e*, 44*f* will not cause the detent to pivot to the depressed position. Each body member includes an aperture 45 into which the detents 44*a* and 44*b* extend when the wheel member 40 is rotated into a position where a dog fixture 38 is aligned with the plunger 24. The stop surfaces 44*e* and 44*f* each engage a peripheral edge portion 47 that, in part, defines the aperture 45.

The aperture 45 is positioned on the body members so that when torque is applied to turn the wheel member 40 in one rotational direction (the "locked direction" indicated by arrow L), one of the stop surfaces 44*e*, 44*f* will bear against the peripheral edge portion 47 and prevent wheel member 40 from rotating, thereby maintaining the alignment of the dog fixture 38 and the plunger 22. In the illustrated embodiment, the apertures 45 are configured so that if torque is applied to the wheel member 40 in the rotational direction opposite from the locked direction (the "rotatable direction" indicated by arrow R), pressure is applied on the ramped surfaces 44*c*, 44*d*, causing the protruding portions of the detents 44*a*, 44*b* to inwardly pivot towards each other. The detents 44 will then pivot into the depressed positions and permit the wheel member 40 to rotate. The apertures 45 can take the form of slots 20*b* (FIG. 2) in body members 20 into which a detent 44*a* or 44*b* protrudes in the extended position. Rotation of the wheel member 40 moves the dog fixtures 38, 38' into and out of alignment with the plunger 22 and is used to dispose a desired dog fixture on the wheel member 40 into alignment with the plunger.

Figure 3:
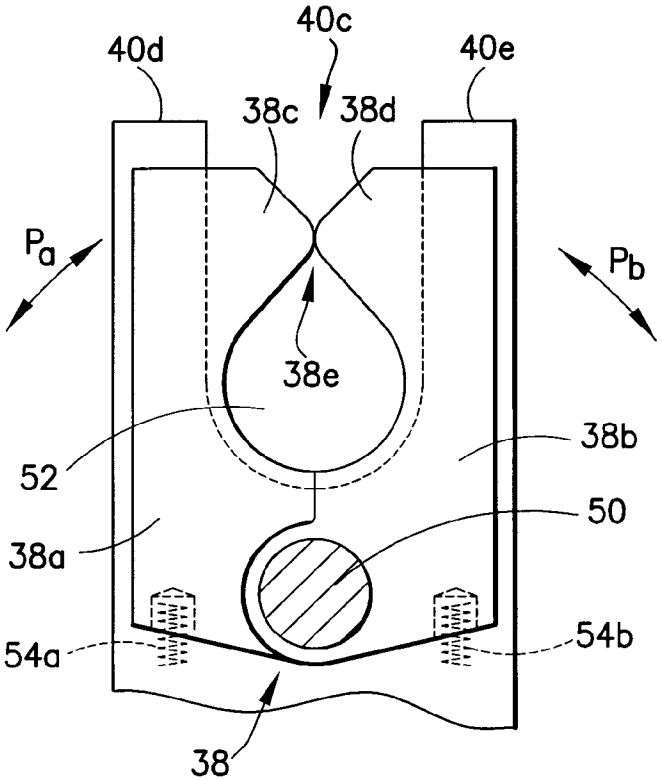
FIG. 3 is a schematic elevation view of a dog fixture of the assembly tool shown in FIG. 1, taken along line 3-3.

As shown in FIG. 3, a dog fixture 38 comprises two jaws 38*a* and 38*b*. The jaws 38*a* and 38*b* are pivotably mounted on dog pin 50 and have closure portions 38*c* and 38*d* distal from the dog pin. Closure portions 38*c*, 38*d* can pivot toward each other into contact with each other at a mutual contact point 38*e*. Dog springs 54*a*, 54*b* bear against the jaws 38*a* and 38*b* and the wheel member 40, and bias the jaws into contact with each other. The jaws 38*a* and 38*b* are configured to define a cable aperture 52 between them. Optionally, each of the dog fixtures 38, 38' on the wheel member 40 has a cable aperture 52 that is different in size from the cable aperture of the other dog fixtures on the wheel member.

The jaws 38*a* and 38*b* have angled surfaces adjacent the mutual contact point 38*e*. By pressing a cable against the angled surfaces, the two closure portions 38*c* and 38*d* can be separated from each other (as indicated by the pivot arrows Pa, Pb) so that the cable can be introduced into, or removed from, the cable aperture 52. However, the dog springs 54 provide a degree of resistance to hold a cable in the aperture during routine use of the assembly tool 10. The wheel member 40 is configured to define a wheel cable groove 40*c* between two wheel portions 40*d*, 40*e*. The wheel cable groove 40*c* is on the periphery of the wheel member 40, for receiving a cable that is to be inserted into the cable aperture 52. In addition, the wheel portions 40*d*, 40*e* are adjacent to the dog fixtures 38, 38' on the opposite side of the dog fixtures from the plunger 22. In this way, the wheel portions 40*d*, 40*e* provide support to the dog fixture when the plunger secures a connector onto the cable.

To prepare the assembly tool 10 for use, the wheel member 40 is rotated to align one of the dog fixtures 38, 38' with the plunger. The aligned dog fixture 38 is sized for applying a connector to a selected cable. Once a selected dog fixture 38 is aligned with the plunger 22, a connector is placed on the end of a cable and the cable is placed in the wheel cable groove 40*c* and is slid into the cable aperture 52 of the dog fixture. The end of the cable and the cable connector thereon are disposed between the dog fixture and the plunger. The user squeezes the handle 28 toward a second handle portion 20*a* defined by the side plates 20 to move the plunger 22 toward the extended position. In the extended position, the plunger tip 24 is used to press a connector against the dog fixture 38 with sufficient force to deform the connector such that the connector becomes secured to the cable. The wheel portions 40*d*, 40*e* (FIG. 3) and the resistance to rotation in the locking direction provided by the stop surfaces 44*e*, 44*f* (FIG. 2) of the detents 44*a*, 44*b* support the dog fixture 38 and thus prevent the dog fixture from being displaced by the force of the plunger 24. To install a connector on a cable sized for another dog fixture 38 on the wheel member 40, the user rotates the wheel member in the rotatable direction to align the desired dog fixture with the plunger.

Optionally, dog pin 50 may be part of a wheel lock pin 46, as shown in FIG. 1.

A wheel lock pin 46 and/or a dog pin 50 may be a set screw that is threaded into the wheel member 40, or they may be manually removable from the wheel member. A manually removable pin does not mechanically couple with the wheel member 40 by means of a thread. For example, a manually removable dog pin 50 or wheel lock pin 46 may have a circumferential groove thereon that engages a spring pin such as spring pin 56*a* or 56*b*, as shown in FIG. 1. This will allow a user to easily remove a dog fixture 38 and replace the dog fixture with another. Since the cable aperture 52 in a dog fixture 38 is sized for a specific-sized cable, providing easily removable dog fixtures allows a user to adapt the assembly tool 10 for use with even more different sizes of cables than the number of dog fixtures that are mountable on the wheel member 40 at any given time. Accordingly, the method of using the attachment tool 10 may include installing a dog fixture 38 for a desired cable on the wheel member 40.

To protect the dog pin 50 or wheel lock pin 46 from damage, the assembly tool 10 may include a cover member 58 (FIG. 1) that is installable on the periphery of the wheel member 40 to cover the dog pin or the wheel lock pin and the mechanism thereon. The cover member 58 may be held on the wheel member 40 by a cover pin 60 that may be part of the cover member and that is received in a mounting hole in the wheel member. Optionally, the cover member 58 may carry a wheel lock pin 46 or a dog pin 50 thereon for manual insertion and/or removal with the cover member. The protected mechanism may be adapted to accommodate the cover member 58 and/or the cover pin 60. For example, the detents 44*a*, 44*b* (FIG. 2) include semi-circular cut-outs 44*g*, 44*h* so the cover member pin 60 can extend between the detents without interfering with the movement of the detents to the depressed position. Where necessary, dog parts 38*a* and 38*b* can also be configured to accommodate a cover pin.

Figure 4:
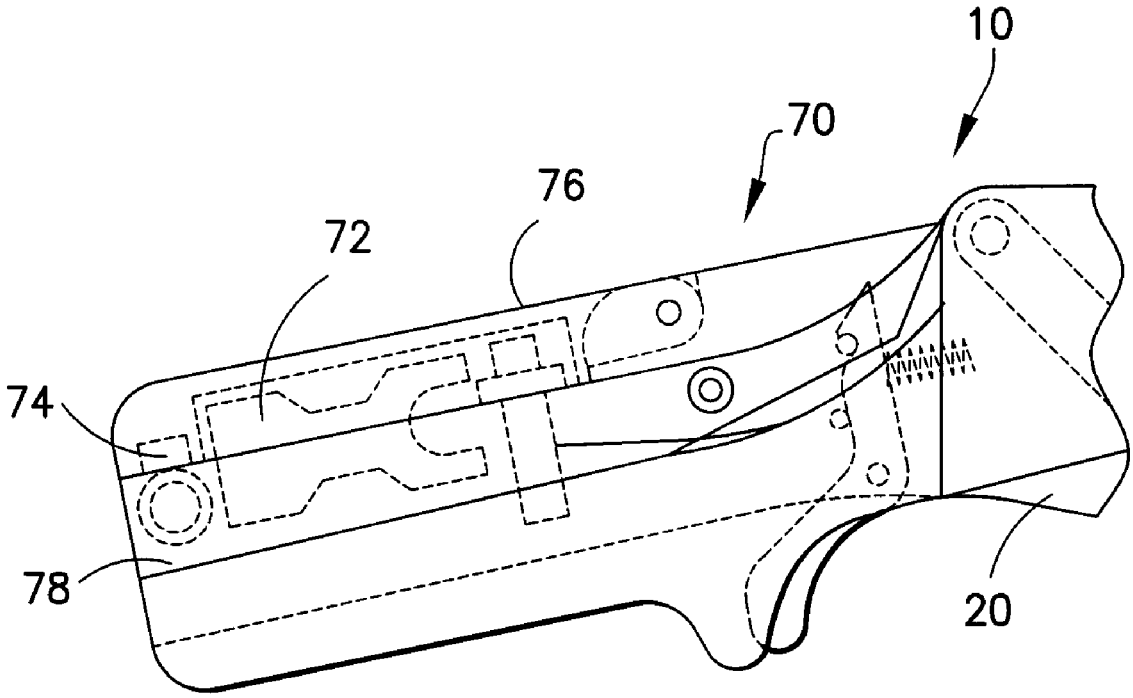
FIG. 4 is a partial, schematic elevation view of the assembly tool shown in FIG. 1 including a toolbox according to an optional embodiment of the invention.

In an optional embodiment shown in FIG. 4, an attachment tool 10 may include a toolbox 70 in the handle portion 20*a*. The toolbox 70, which may be disposed, for example, between the side plates 20, may contain a sizing tool 72 and a substitute plunger tip. The sizing tool 72 is used to determine the size of a cable so that a properly sized cable connector and dog fixture can be selected. The toolbox 70 may include a magnet clasp assembly 74, to help keep a pivotable top 72 in a closed position on the tool box bottom 78 during storage and handling.

The terms "first," "second," and the like, herein do not denote any order, quantity, or importance, but rather are used to distinguish one element from another. In addition, the terms "a" and "an" herein do not denote a limitation of quantity, but rather denote the presence of at least one of the referenced item.

Although the invention has been described with reference to particular embodiments thereof, it will be understood by one of ordinary skill in the art, upon a reading and understanding of the foregoing disclosure, that numerous variations and alterations to the disclosed embodiments will fall within the spirit and scope of this invention and of the appended claims.

What is claimed is:

1. A tool comprising:

a pair of body members;

a plunger positioned between and coupled to the body members for movement between an extended and retracted position;

a handle portion pivotally coupled to at least one of the body members for movement relative thereto, said handle portion being further coupled to the plunger so that movement of the handle portion causes the plunger to move;

a wheel member positioned between and rotatably mounted to the body members for rotation about an axis of rotation;

at least two dog fixtures coupled to the wheel member, the at least two dog fixtures cooperate to define a cable aperture between, and wherein the cable aperture is of a size and shape to at least partially encircle a cable; and a detent mechanism that provides engagement between the wheel member and the body members to define a plurality of rotational positions for the wheel member, wherein each rotational position disposes one of the dog fixtures in alignment with the plunger.

2. The tool of claim 1, wherein the detent mechanism defines a pair of detents, each moveable between an extended and retracted position, the detents each being engageable with an aperture defined by said body members so that upon rotation of the wheel member, when the detents align with the apertures, the detents move from the retracted to the extended positions, thereby releasably retaining the wheel member in a position where one of the dog fixtures is aligned with the plunger.

3. The tool of claim 2 wherein the detent mechanism includes a first pair of detents, each defining a ramped portion and a stop surface, the stop surface being engageable with a peripheral edge portion that in part defines the aperture, so that upon engagement of the stop surface with the peripheral edge portion, further rotation of the wheel member is prevented in the first direction, when the wheel member is rotated in a second direction generally opposite the first direction, the ramped surfaces defined by each of the first pair of detents progressively engages the body members moving the detents from the extended to the retracted position, further rotation in the second direction causes a second pair of detents forming part of the detent mechanism to engage the apertures and move from the retracted to the extended position, thereby causing stop surfaces defined by each of the second pair of detents to engage peripheral edge portions defining the apertures, thereby preventing further rotation of the wheel member in the second direction.

4. The tool of claim 3, wherein the detent mechanism includes a pair of springs, one associated with each of the first and second pair of detents for urging the detents toward the extended position.

5. The tool of claim 1 further comprising a locking mechanism for releasably retaining the handle portion in a retracted position, the locking mechanism including: a trigger coupled to the handle portion for movement, between a locked and unlocked position, biasing means for urging the trigger toward the locked position, said trigger including a locking portion adapted to releasably engage a locking pin coupled to at least one of the body members.

6. The tool of claim 1 wherein each of the dog fixtures is defined by a pair of jaws moveable between an open and closed position, the jaws cooperating to define a hole therethrough adapted to receive a cable.

7. The tool of claim 6 further comprising biasing means for urging each pair of jaws toward the closed position.

8. The tool of claim 1, wherein the wheel member comprises a peripheral groove for receiving a cable, the groove being situated adjacent a dog fixture such that the groove is opposite the plunger when the dog fixture is aligned with the plunger.

9. The tool of claim 8, wherein the wheel is configured to provide support for the dog fixture.

* * * * *